US009640349B2

(12) United States Patent
Hashimoto et al.

(10) Patent No.: US 9,640,349 B2
(45) Date of Patent: May 2, 2017

(54) GAS CIRCUIT BREAKER

(71) Applicant: Hitachi, Ltd., Chiyoda-ku, Tokyo (JP)

(72) Inventors: Hiroaki Hashimoto, Tokyo (JP); Kenichi Okubo, Tokyo (JP); Go Kobayashi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 207 days.

(21) Appl. No.: 14/540,557

(22) Filed: Nov. 13, 2014

(65) Prior Publication Data

US 2015/0136739 A1 May 21, 2015

(30) Foreign Application Priority Data

Nov. 15, 2013 (JP) ..... 2013-236398

(51) Int. Cl.
*H01H 33/56* (2006.01)
*H01H 33/40* (2006.01)

(52) U.S. Cl.
CPC ..... *H01H 33/565* (2013.01); *H01H 33/40* (2013.01)

(58) Field of Classification Search
CPC ..... H01H 3/3015; H01H 33/36; H01H 33/40; H01H 33/42; H01H 3/38; H01H 3/46; H01H 9/0027; H01H 9/0038; H01H 2235/01; H01H 33/666; H01H 3/28; H01H 2003/268; H01H 31/32; H01H 33/6661
See application file for complete search history.

(56) References Cited

U.S. PATENT DOCUMENTS 3,527,912 A * 9/1970 Jaillet ..... H01H 33/91 218/66
4,027,125 A * 5/1977 Peek ..... H01H 3/30 200/308

(Continued)

FOREIGN PATENT DOCUMENTS

CN 1941244 A 4/2007
CN 101770891 A 7/2010

(Continued)

OTHER PUBLICATIONS

Chinese-language Office Action issued in counterpart Chinese Application No. 201410641284.2 dated Apr. 22, 2016 with English translation (Nineteen (19) pages).

(Continued)

*Primary Examiner* — Truc Nguyen
(74) *Attorney, Agent, or Firm* — Crowell & Moring LLP

(57) ABSTRACT

The gas circuit breaker is made up of a fixed contact, a movable contact, a sealed tank having the fixed contact and the movable contact therein, an operating mechanism for driving the movable contact, and a mechanism unit for housing a link mechanism for connecting the operating mechanism with the movable contact. The operating mechanism is made up of an opening spring and a closing spring, cases for covering respective peripheries of those elastic bodies, a control mechanism for holding and freeing the driving force of the elastic body, and a link mechanism for conveying the driving force of the elastic body to the movable contact. The opening spring is laterally disposed in the axial direction between the link mechanism and the control mechanism. An integral flange is provided on an opening spring case and a closing spring case.

12 Claims, 6 Drawing Sheets

(56) References Cited

U.S. PATENT DOCUMENTS

| | | | | |
|---|---|---|---|---|
| 5,059,753 | A * | 10/1991 | Hamm | H01B 17/26 218/84 |
| 5,448,030 | A | 9/1995 | Yamamoto et al. | |
| 5,508,487 | A * | 4/1996 | Smith | H01H 3/3031 200/400 |
| 6,156,989 | A * | 12/2000 | Miller | H01H 33/666 218/120 |
| 6,407,908 | B1 * | 6/2002 | Iryo | H01H 33/42 200/82 B |
| 6,818,850 | B2 * | 11/2004 | Bridges | H01H 33/666 218/154 |
| 7,115,828 | B2 * | 10/2006 | McCord | H01H 3/3031 200/400 |
| 7,915,558 | B2 * | 3/2011 | Nelson | H02B 5/00 218/155 |
| 2003/0231452 | A1 | 12/2003 | Hetzmannseder et al. | |
| 2007/0068903 | A1 | 3/2007 | Hashimoto et al. | |
| 2013/0146565 | A1 * | 6/2013 | Nakayama | H01H 33/6662 218/120 |

FOREIGN PATENT DOCUMENTS

| | | | |
|---|---|---|---|
| CN | 102403162 | A | 4/2012 |
| JP | 51-13971 | | 2/1976 |
| JP | 54-12059 | | 1/1979 |
| JP | 64-6340 | A | 1/1989 |
| JP | 6-60778 | A | 3/1994 |
| JP | 2003-229038 | A | 8/2003 |
| JP | 2007-294363 | A | 11/2007 |
| JP | 2010-160926 | A | 7/2010 |
| JP | 2011-29004 | A | 2/2011 |

OTHER PUBLICATIONS

Korean-language Office Action issued in counterpart Korean Application No. 10-2014-0154345 dated Jun. 16, 2016 with English translation (Eight (8) pages).

Japanese-language Office Action issued in counterpart Japanese Application No. 2013-236398 dated Nov. 1, 2016 with English translation (5 pages).

* cited by examiner

GAS CIRCUIT BREAKER

CLAIM OF PRIORITY

The present application claims priority from Japanese application serial no. 2013-236398, filed on Nov. 15, 2013, the content of which is hereby incorporated by reference into this application.

FIELD OF THE INVENTION

The invention relates to a gas circuit breaker and in particular, to a gas circuit breaker having achieved suppression of vibration at the time of the breaker in operation, and enhancement in maintainability, together with lower height.

BACKGROUND OF THE INVENTION

For an operating mechanism of a gas circuit breaker, use is generally made of a pneumatic operating mechanism and a hydraulic operating mechanism for obtaining operational ability by making use of an air pressure and an oil pressure, respectively, and a spring operating mechanism for obtaining operational ability by freeing the compressive force of a spring as an elastic body.

In Japanese Unexamined Patent Application Publication No. 2011-29004 (Patent Document 1), there is described an example of a gas circuit breaker using a spring as a driving source. This gas circuit breaker is made up such that an opening unit tank, a link mechanism unit, and an operating mechanism are disposed in the lateral direction so as to be adjacent to each other, and a gas-sealed chamber communicating with the opening unit tank is formed between the opening unit tank and the operating mechanism. The purpose of adopting such a configuration described as above is to provide a gas circuit breaker capable of efficiently reducing leakage of an insulating gas inside the opening unit tank, while reducing a dimension in height.

In Japanese Unexamined Patent Application Publication No. 2007-294363 (Patent Document 2), there is described a gas circuit breaker as another example of the gas circuit breaker using a spring as a driving source. With this gas circuit breaker, it is intended that spots for mounting an auxiliary control unit, etc., in a spring operating mechanism, are altered as appropriate according to the configuration of the breaker, thereby causing the center axis of the tank to be substantially coincidental with the center of the spring operating mechanism, while enhancing operability and maintainability of the operating mechanism, thereby implementing well-balanced miniaturization of the gas circuit breaker as a whole.

With respective configurations of the Patent Documents 1 and 2, however, an operation direction of the spring as the driving source is orthogonal to that of a contact point of an opening unit, so that a link mechanism becomes complicated, posing a problem of deterioration in efficiency of energy for driving the contact point of the opening unit.

Further, the spring as the driving source is housed in a guide or a case, however, the spring as the driving source is butted against the guide or the case when the spring as the driving source is activated because the guide or the case is supported in a cantilever state against an enclosure to thereby cause the guide or the case to undergo vibration, resulting in the problem of deterioration in efficiency of the energy for driving the contact point of the opening unit.

Furthermore, with the gas circuit breaker shown in the Patent Document 2, since a link mechanism for connection between the spring operating mechanism and the opening unit is not provided with an adjustable portion, it is difficult to adjust a wipe amount at the contact point of the opening unit, in the field where a product is installed, thereby causing a problem with maintainability.

It is an object of the invention to solve those problems, and more specifically, the invention intends to provide a gas circuit breaker capable of realizing miniaturization by total-height control, suppression of vibration at the time of an operation, and enhancement in maintainability, and a gas insulated switchgear using the same.

SUMMARY OF THE INVENTION

According to the present invention, there is provided a gas circuit breaker having a fixed contact, a movable contact coming into contact with, and being dissociated from the fixed contact, a sealed tank having the fixed contact and the movable contact therein, an operating mechanism for driving the movable contact, and a mechanism unit provided between the sealed tank and the operating mechanism. The operating mechanism includes an elastic body as a driving source, a case for housing the elastic body, a control mechanism for holding and freeing a driving force of the elastic body, and a link mechanism for conveying the driving force of the elastic body to the movable contact. The elastic body is made up of an opening elastic body and a closing elastic body, the opening elastic body is laterally disposed in the axial direction between the link mechanism and the control mechanism, and a flange provided on the opening elastic body case is integrated with a flange provided on the closing elastic body case.

With the gas circuit breaker according to the invention, it becomes possible to realize miniaturization by total-height control, suppression of vibration at the time of an operation, and enhancement in maintainability.

DETAILED DESCRIPTION OF THE PREFERRED EMBODIMENTS

Figure 1:
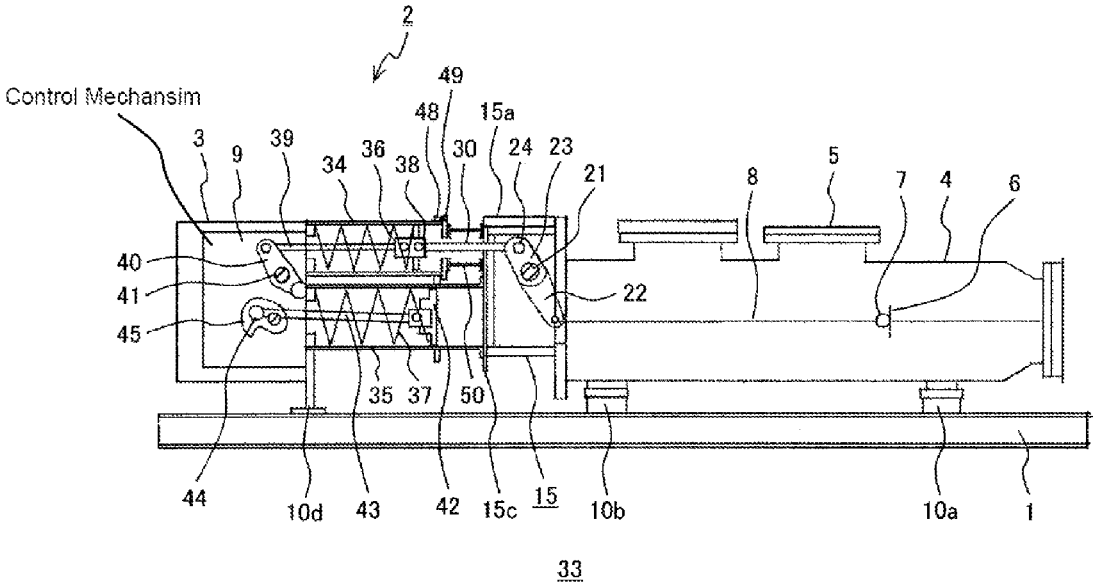
FIG. 1 is a side view of a gas circuit breaker according to a first embodiment of the invention, showing an opening unit in the on-state, and a sectional view of an operating mechanism potion of the breaker, while indicating a fixed side as well as a movable side by a dotted line (the same is applied to FIGS. 2, 3, 5, and 7)

Preferred embodiments of the invention are described below with reference to the accompanied drawings. It is to be understood that the embodiments described below are just for illustrative purposes only and that the invention be not limited by any of to the details of a specific embodiment described below. Obviously many modifications and variations of the invention itself are possible without departing from the spirit or scope of the appended claims.

First Embodiment

A gas circuit breaker according to a first embodiment of the invention is described with reference to FIGS. 1 through 4, and 7. A gas circuit breaker 33 is made up of a sealed tank 4 for housing an opening unit therein, a spring operating mechanism 2, and a mechanism unit 15 for connecting the spring operating mechanism 2 with the sealed tank 4. The sealed tank 4 is connected to a common frame 1 via leg parts 10*a*, 10*b*, respectively, and an insulating gas such as, for example, $SF_6$ (a sulfur hexafluoride gas), is sealed in the sealed tank 4 under a prescribed pressure.

Within the sealed tank 4, a contact point of the opening unit is energized, the contact point being made up of a movable contact 7 and a fixed contact 6 with a conductor (not shown) interposed therebetween. An insulating link 8 is connected to a side of the movable contact 7, opposite from a side thereof, in contact with the fixed contact 6. A driving force of the spring operating mechanism 2 acts on the insulating link via the mechanism unit 15, thereby executing opening/closing of the contact point of the opening unit.

FIG. 1 shows a state where the movable contact 7 is in contact with the fixed contact 6, in other words, a state where the contact point of the opening unit is in the on-state. By so doing, power is distributed from a bus toward a transmission line. If an abnormal current flows in an energized state, due to cloud-to-ground discharge, etc., an opening command is delivered to the gas circuit breaker 33, and the movable contact 7 is dissociated from the fixed contact 6, thereby cutting off the current.

The mechanism unit 15 is connected to a flange of the sealed tank 4, on a side of the insulating link 8, adjacent to an extension end thereof. Further, a rotation axis 21 is mounted inside the mechanism unit 15, and a gas lever 22 and an air lever 23 are fixed to the rotation axis 21.

The mechanism unit 15 is provided with both a gas-sealed chamber and an atmospheric chamber, (not shown), communicating with the sealed tank 4, and the rotation axis 21 penetrates through the respective chambers to be supported thereby, while the mechanism unit 15 is provided with a gas-sealing means (not shown). The gas lever 22 is connected to a side of the rotation axis 21, adjacent to the gas-sealed chamber, and the air lever 23 is connected to a side of the rotation axis 21, adjacent to the atmospheric chamber. The insulating link 8 is connected to an end of the gas lever 22. An output link 30 extended from the spring operating mechanism 2 is linked to an end of the air lever 23 by use of a pin 24, in a freely and rotatively reciprocating manner.

Thus, the air lever 23 and the gas lever 22 are disposed in the mechanism unit 15, however, the present invention is not limited thereto and the gas lever 22 and the air lever 23 may be disposed in the sealed tank 4 instead of the mechanism unit 15. Further, with the configuration described as above, the gas-sealed chamber and the atmospheric chamber are each partitioned off at the rotation axis 21, however, the present invention is not limited thereto, and partition thereof may be made at a longitudinal motion part such as the output link 30.

Next, a configuration of the spring operating mechanism 2 is described below. The spring operating mechanism 2 is connected to a plate 15*c* of the mechanism unit 15, while being connected to the common frame 1 as well via a leg part 10*d*. Further, an operation box 3 is provided in such a way as to cover an enclosure 9 and a control mechanism (which is located inside the enclosure 9 and thus not shown).

With the spring operating mechanism 2, an opening spring case 34 and a closing spring case 35, cylindrical in shape, are fixed to the enclosure 9 inside the operation box 3. Further, an end 35*b* of the closing spring case 35, on a side thereof, opposite from an end thereof, connected to the enclosure 9, is fixed to the mechanism unit 15. An opening spring 36 and a closing spring 37 are housed in the two spring cases, respectively.

Figure 4:
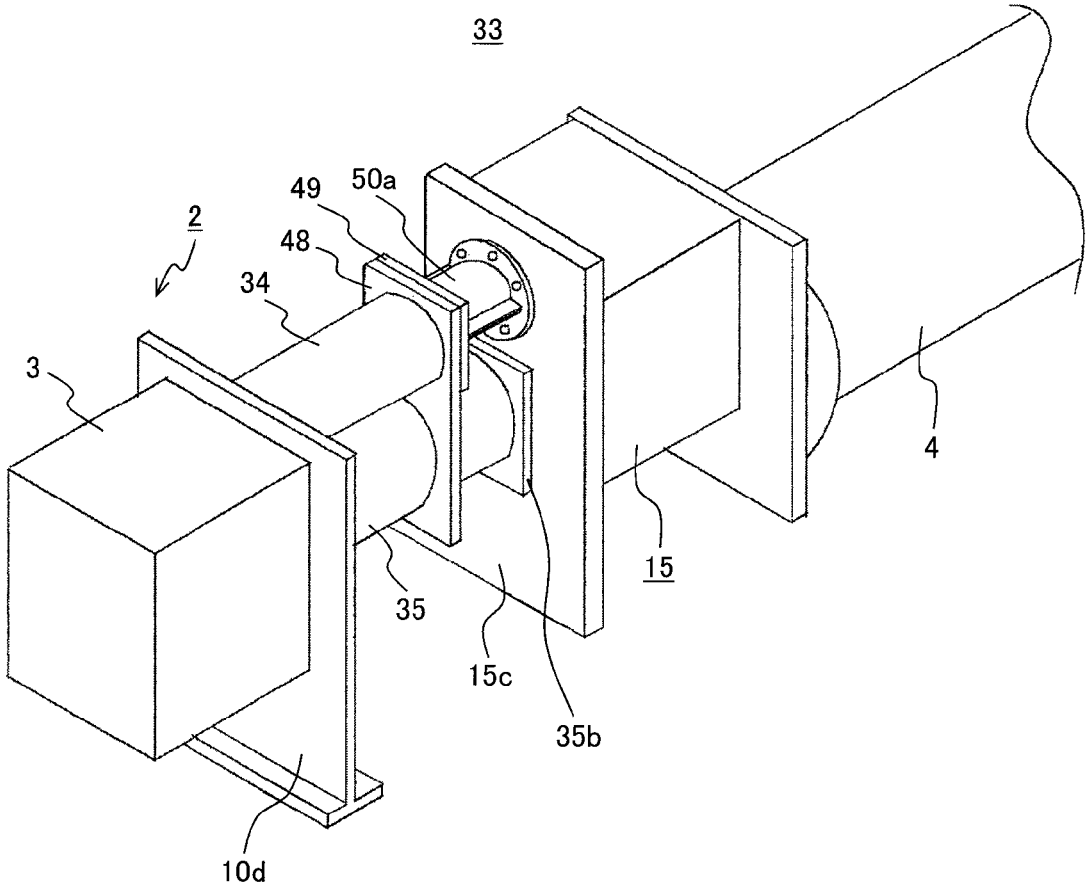
FIG. 4 is a perspective view of the gas circuit breaker according to the first embodiment of the invention, showing an operating mechanism and a mechanism unit.

The opening spring case 34 and the closing spring case 35 are integrated with each other by use of a flange 48, as shown in FIG. 4. A stopper flange 49 for restricting an over-stroke of the opening spring at the time of an opening operation is fastened to a face of the flange 48, on a side thereof, opposite from the opening spring case 34. A vertically-dividable type waterproof cover 50 that is detachable and attachable is connected between the stopper flange 49 and the plate 15*c* of the mechanism unit 15. If a configuration described as above is adopted, the control mechanism of the spring operating mechanism 2, and the spring serving as the driving source can be rendered waterproof, and the operation box 3 can be miniaturized.

In FIG. 1, both the spring for use in the opening and the spring for use in the closing, are in as-compressed state. The opening spring 36 has an end supported by the enclosure 9 and the other end supported by an opening spring bearing 38. An end of an opening spring link 39 is connected to an end of the opening spring bearing 38. The other end of the opening spring link 39 is connected to one end of a main lever 40. The main lever 40 has an intermediate part fixed to a rotation axis 41 supported by the enclosure 9 in a freely and rotatively reciprocating manner.

Further, an end of the output link 30 is connected to the other end of the opening spring bearing 38. In comparison of the configuration of the present embodiment with the configuration described in Cited Literature 1, it is found that, in the case of the configuration described in Cited Literature 1, an output link is linked to an air lever 23 extended from a main lever 31 of an operating mechanism, so that an output link 30 becomes larger in length, and therefore, there has been the need for rendering moment of inertia of the cross section with respect to the output link to be greater than that in the case of the present embodiment in order to avoid buckling occurring in the case of an abruptly increasing compression load acting thereon.

With the present embodiment, even if the abruptly increasing compression load acts on the output link 30 at the time of the opening operation, it is possible to render the output link 30 to be smaller in length in comparison with the case of the configuration described in Cited Literature 1, as shown in FIG. 1, so that the risk of buckling occurring to the output link 30 can be reduced. As a result, reliability of the operating mechanism can be enhanced.

Further, the output link 30 made up of one member is depicted in the figure, however, the output link 30 may be structured such that not less than two members are fastened to each other with the use a turnbuckle. By so doing, a wipe amount in the opening unit can be adjusted, as described below with reference to FIG. 7.

Figure 7:
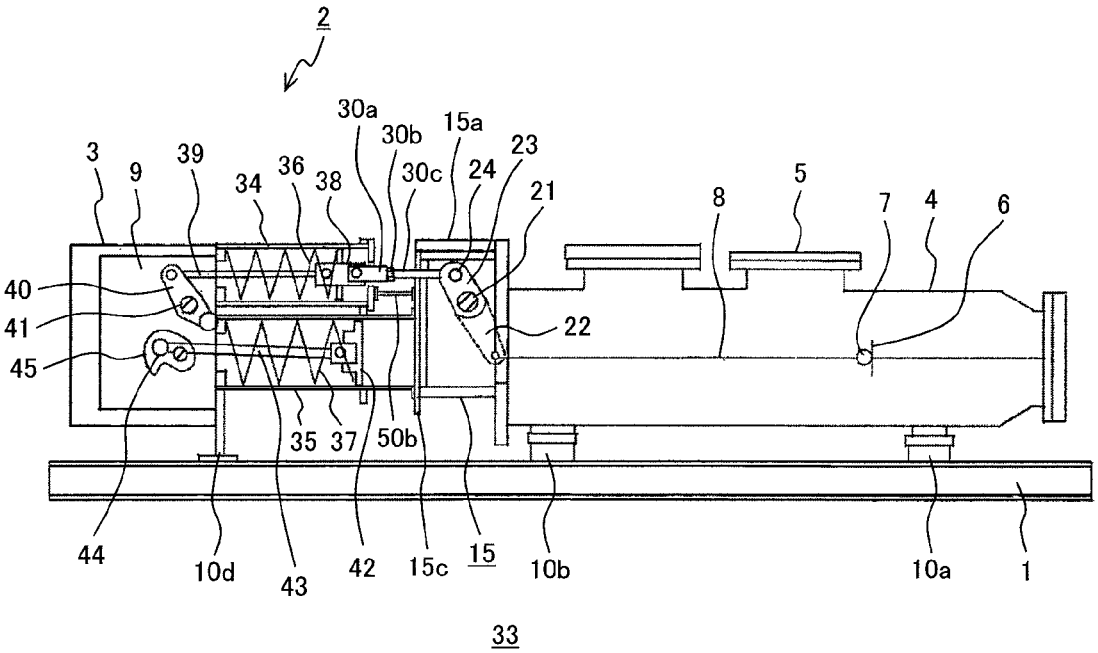
FIG. 7 is a side view of the gas circuit breaker according to the first embodiment, for explaining about a link mechanism provided between an opening spring and a movable contact.

In FIG. 7, a configuration with respect to an operating mechanism, a mechanism unit, and an opening unit, other than an output link 30, is identical to the respective configurations of those corresponding thereto, shown in FIG. 1. The output link 30 is made up of a link 30*a* structured such that one end thereof is supported by the spring bearing 38 in a freely rotatively reciprocating manner, allowing a link 30*c* to be inserted into the other end of the link 30*a*, up to a predetermined length, and the link 30*c* with one end supported by the air lever 23, in a freely and rotatively reciprocating manner, by use of the pin 24, an intermediate part of the link 30*c*, being provided with a screwed portion, thereby enabling the link 30*a* to be fastened to the link 30*c* by use of a nut 30*b*.

With the adoption of such a configuration described as above, since it is possible to adjust a length of a portion of the link 30*c*, protruding out of the link 30*a*, by loosening the nut 30*b*, even in the case where the opening spring 36 is in as-compressed state, it becomes possible to adjust an overlap length of the movable contact, against the fixed contact 6, that is, the wipe amount in the opening unit. If on-site adjustment is required, necessary work can be performed by simply removing only an upper half 50*b* of the waterproof cover 50, as shown in FIG. 7, so that maintainability is enhanced.

Further, the opening spring 36 is laterally disposed in the axial direction. More preferably, an operation axis of the opening spring 36 is provided so as to be substantially parallel with an operation axis of the movable contact 7.

With the adoption of the configuration described as above, a linkage mechanism for conveying the driving force of an operating mechanism to the movable contact can be simplified as compared with the case where the operation axis of the opening spring is substantially orthogonal to the operation axis of the movable contact, as is the case with the configuration described in the Patent Documents 1 and 2, respectively, so that the driving force of the operating mechanism 2 can be efficiently conveyed to the movable contact 7.

Further, there are no particular limitations to a position where the closing spring 37 is provided, and the closing spring 37 may be provided either on the upper side or the lower side of the opening spring 36, or alternatively, on a lateral face of the opening spring 36. However, the closing spring 37 is preferably disposed below the opening spring 36, and more preferably, vertically below the opening spring 36, for the purposes of lowering the center of gravity, and increasing earthquake-resistance, with respect to the breaker.

Further, an end of the closing spring 37 of the spring operating mechanism 2 is supported by the enclosure 9, and the other end of the closing spring 37 is supported by a closing spring bearing 42. An end of a closing spring link 43 is connected to the closing spring bearing 42. A closing cam 45 is linked to the other end of the closing spring link 43 in a freely and rotatively reciprocating manner. The closing cam 45 is fixed to a rotation axis 44 supported by the enclosure 9 in a freely and rotatively reciprocating manner.

With the operating mechanism 2, the enclosure 9 is provided with gears (not shown) and an electric motor (not shown) in order to effect recompression after the closing spring 37 is freed by a closing operation at the contact point. In addition, a mechanism (not shown) is provided in the enclosure 9 in order to hold or free the driving force of the closing spring as well as the opening spring, in as-compressed state.

Now, referring to FIGS. 1 through 3, the operation of the gas circuit breaker 33 is described below. First, there is described an operation whereby the on-state of the contact point of the opening unit, as shown in FIG. 1, is shifted to the off-state. In FIG. 1, upon the opening command being delivered to the gas circuit breaker 33, a cut-off operation at the contact point is started.

More specifically, in FIG. 1, the control mechanism for the opening spring is actuated to free the opening spring 36 in as-compressed state from restrictions to thereby permit release of the resilience energy of the opening spring 36. By so doing, the driving force of the opening spring 36 is conveyed to the output link 30 via the opening spring link 39, thereby causing the output link 30 to move rightward in the direction parallel to the plane of the figure.

Then, the air lever 23 of the mechanism unit 15 is caused to rotatively reciprocate clockwise. The rotation axis 21 as well is caused to rotatively reciprocate clockwise, and the gas lever 22 fixed thereto, as well, is caused to rotatively reciprocate clockwise. By so doing, the insulating link 8 is driven leftward in the direction parallel to the plane of the figure, causing the movable contact 7 at the contact point of the opening unit to move leftward in the direction parallel to the plane of the figure to thereby cause the movable contact 7 to lose touch with the fixed contact 6.

At this point in time, the opening spring 36, and the spring bearing 38 are displaced in the direction vertical to the plane of the figure, as well, while being moved substantially in the horizontal direction, thereby causing vibration to propagate to the opening spring case 34. The vibration of the opening spring case 34 is propagated to the closing spring case 35 via the flange 48, and the vibration is propagated from the closing spring case 35 up to the plate 15*c* of the mechanism unit 15. However, with the configuration according to the present embodiment, bending rigidity of the opening spring case 34, in the direction vertical to the plane of the figure, and in the depth direction of the plane of the figure, can be reinforced, as compared with the case of the related art, so that vibration at the time of the opening operation can be suppressed.

Upon completion of the release of the resilience energy of the opening spring 36, the cut-off operation at the contact point comes to the end. In the spring operating mechanism 2, an end of the main lever 40 is substantially abutted against the outer peripheral face of the closing cam 45 to be stopped, as shown in FIG. 2.

Figure 2:
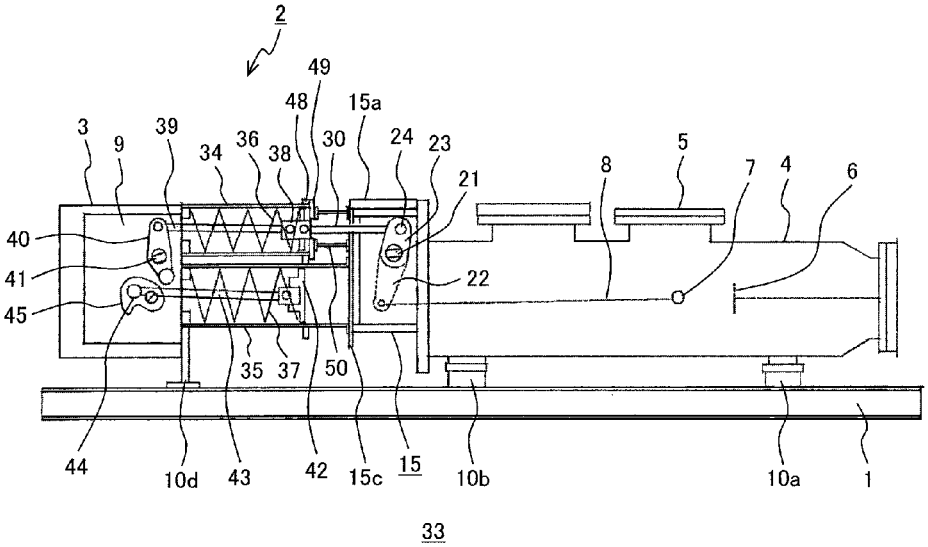
FIG. 2 is a side view of the gas circuit breaker according to the first embodiment of the invention, showing the opening unit in the off-state.

Next, there is described below an operation whereby the off-state of the contact point of the opening unit, shown in FIG. 2, is shifted to the on-state of the contact point, shown in FIG. 3. Upon a closing command being delivered to the gas circuit breaker 33 in the state shown in FIG. 2, a control mechanism (not shown) for the closing spring is actuated to free the closing spring 37 in as-compressed state from restrictions to thereby permit the release of the resilience energy of the closing spring 37. Because the flange 35*b* (refer to FIG. 4) of the closing spring case 35 is rigidly joined to the plate 45*c* of mechanism unit 15, the vibration of the closing spring case 35 can be suppressed even if the closing spring 37 and the closing spring bearing 42 are displaced in the direction vertical to the plane of the figure.

As the resilience energy of the closing spring 37 is released, the closing cam 45, and the rotation axis 44 are caused to rotatively reciprocate clockwise via the closing spring link 43. As the closing cam 45 rotatively reciprocates, the outer peripheral face of the closing cam 45 is pressed against the outer peripheral face of the main lever 40, thereby causing the main lever 40 to rotatively reciprocate counterclockwise. By so doing, the opening spring 36 is compressed through the intermediary of the opening spring link 39 and the opening spring bearing 38.

At the same time, the output link 30 is moved leftward in the direction parallel to the plane of the figure. As a result, both the air lever 23, and the gas lever 22, inside the mechanism unit 15, are caused to rotatively reciprocate clockwise, thereby moving the insulating link 8 rightward in the direction parallel to the plane of the figure. Then, the movable contact 7 linked to the insulating link 8 is moved rightward in the direction parallel to the plane of the figure to come into contact with the fixed contact 6, whereupon the contact point of the opening unit is turned into the on-state. Upon completion of the release of the resilience energy of the closing spring 37, the operation for shifting to the on-state of the contact point, shown in FIG. 3, comes into a completion state.

Figure 3:
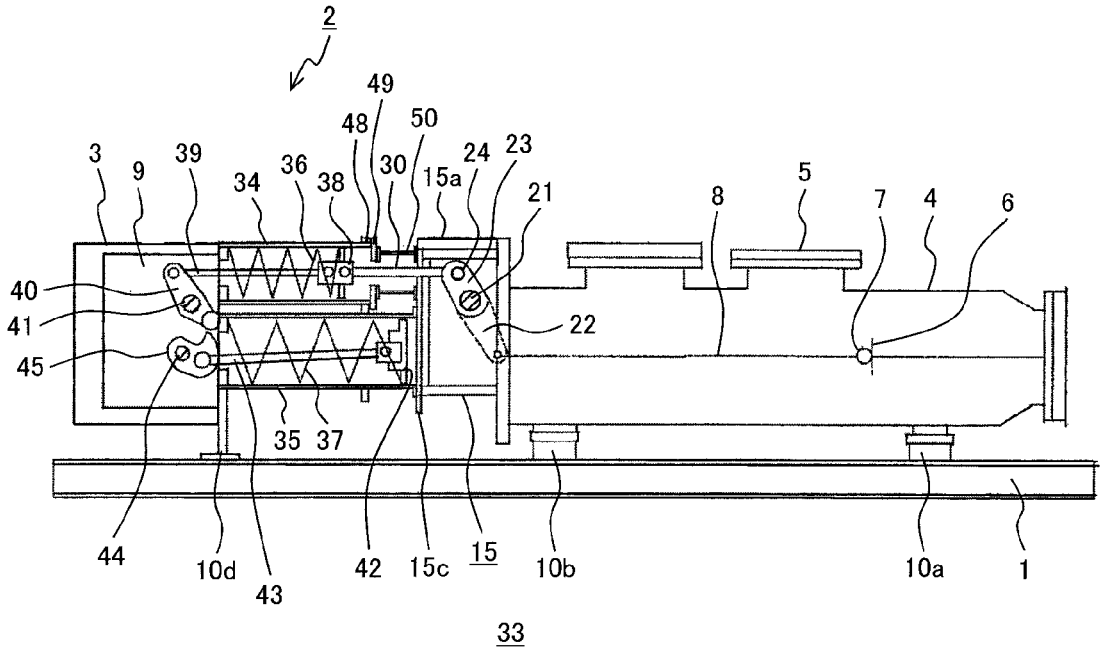
FIG. 3 is a side view of the gas circuit breaker according to the first embodiment of the invention, showing a state where the opening unit is shifted from the off-state of FIG. 2 to the on-state.

By starting from the state where the operation for shifting to the on-state of the contact point is completed, shown in FIG. 3, the closing spring 37 whose resilience energy has been released is compressed by use of the electric motor (not shown) and the gears (not shown), whereupon the operation is shifted to the state shown in FIG. 1, while holding the driving force of the closing spring 37 by use of the control mechanism.

The insulating gas to be sealed in a gas insulated switchgear shown in the present embodiment is not limited to $SF_6$, and for the insulating gas, use maybe made of a $SF_6$ substitute gas, such as, for example, a mixed gas of $SF_6$ and $N_2$, a mixed gas $SF_6$ and $CF_4$, and $CO_2$ gas, etc.

Further, with the spring operating mechanism 2 of the gas circuit breaker according to the present embodiment, for both the opening spring and the closing spring, use is made of a compression coil spring, however, the present invention is not limited thereto, and any longitudinally-moving elastic body element, such as a disc spring, etc., can be easily substituted for the compression coil spring. Furthermore, even if the compression coil spring is used as the main driving source, and a torsion bar spring is adopted as a collateral driving source, the same effect as that of the present embodiment can be obtained.

With the present invention, the operation axis of the opening spring of the spring operating mechanism is rendered substantially parallel with the operation axis of the movable contact, as described in the foregoing, so that the driving force of the spring operating mechanism can be conveyed to the movable contact by use of a simple link mechanism, thereby enabling the driving force of the spring operating mechanism to be efficiently conveyed to the opening unit, as compared with the case of the configuration requiring use of a complex link mechanism due to a configuration in which the operation axis of the opening spring of the spring operating mechanism is substantially orthogonal to the operation axis of the movable contact, and so forth. As a result, the reliability of the gas circuit breaker can be enhanced.

Further, if the operation axis of the spring as the driving source is provided so as to be substantially parallel with the operation axis of the movable contact, and subsequently, a link for causing a conversion lever to swing is connected to an end of the spring, on the right side in the direction parallel to the plane of the figure, this will enable the driving force of the spring to be conveyed to the movable contact with the use of a simple link mechanism, while controlling a link length, so that the efficiency of energy for driving the movable contact can be enhanced.

Further, if the spring operating mechanism and the sealed tank, respectively, are fixed onto the frame, effects of the vibration occurring at the time of the opening operation, on the spring operating mechanism, can be reduced, as compared with the case of a gas circuit breaker often adopted in the traditional configuration in which the operating mechanism is supported by the sealed tank in a cantilever-like manner so as to be floated from the frame, thereby enhancing operation stability.

Figure 5:
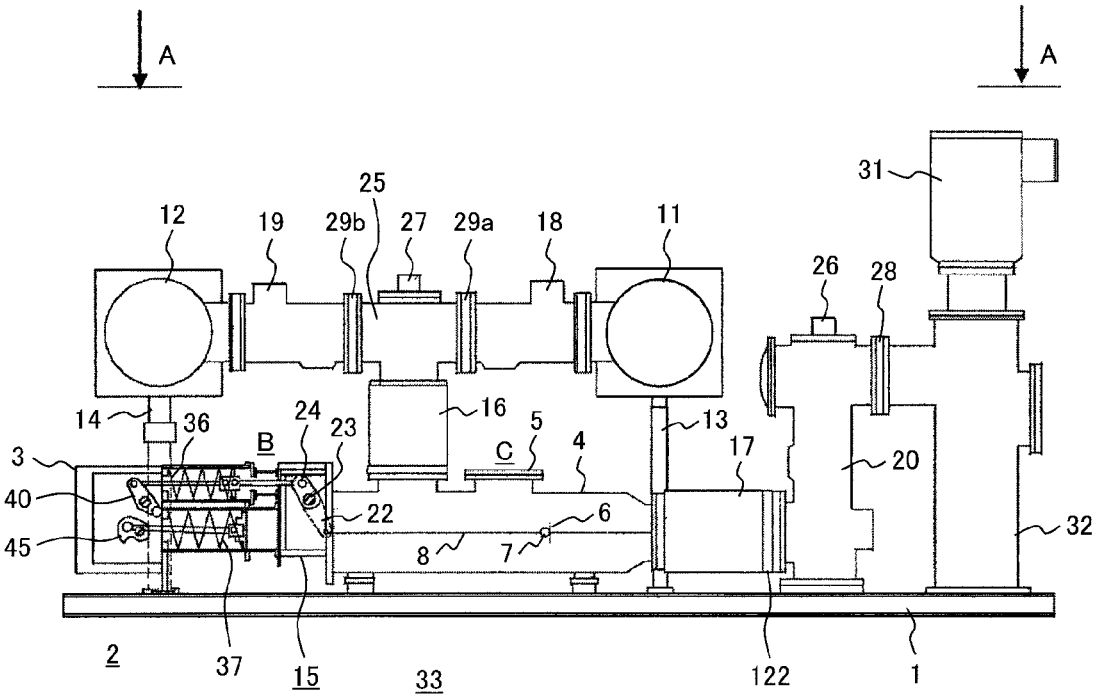
FIG. 5 is a side view of the gas circuit breaker according to the first embodiment of the invention, showing a state where the gas circuit breaker according to the first embodiment is assembled into a gas insulated switchgear.
Figure 6:
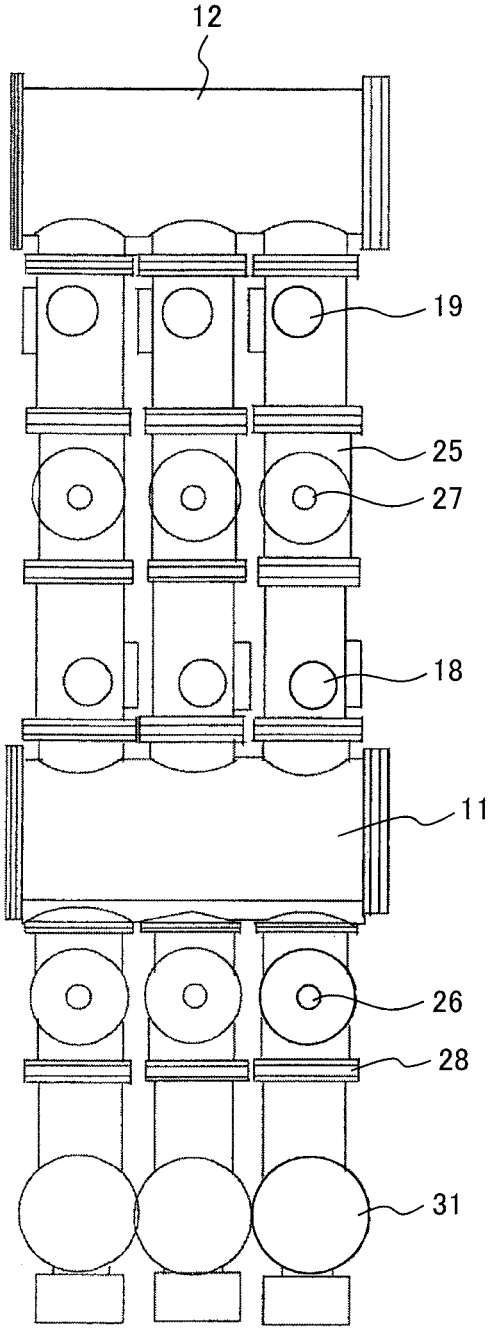
FIG. 6 is a plan view of the gas circuit breaker according to the first embodiment of the invention, showing a state where the gas circuit breaker according to the first embodiment is assembled into a gas insulated switchgear.

FIGS. 5, and 6 each show a state where the gas circuit breaker according to the first embodiment of the invention is assembled into a gas insulated switchgear. The gas insulated switchgear, shown in FIG. 5, includes the gas circuit breaker 33 that is horizontally disposed, and both a current transformer 16 for use as a measuring instrument, and a bus-connection conductor 25, connected to an upper part of the gas circuit breaker 33. An earthing device 27 is connected to an upper part of the bus-connection conductor 25 via a flange. Main-bus disconnectors 18, 19 are provided on the respective sides of each of insulating spacers 29*a*, 29*b*, disposed on the respective sides of the bus-connection conductor 25. The main-bus disconnectors 18, 19 are provided with main-bus containers 11, 12, respectively, the main-bus containers 11, 12 each being extended in the direction substantially orthogonal to the axial direction of the gas circuit breaker 33.

An operating-mechanism-side working space B is provided in space surrounded by the main-bus container 12, the disconnector 19, the current transformer 16, and the spring operating mechanism 2, and an opening-unit-side working space C is provided in space surrounded by the main-bus container 11, the disconnector 18, the current transformer 16, and the sealed tank 4.

It needs only be sufficient for each of these working spaces to have a height and a width, sufficient for a worker to creep therein to perform a maintenance work. In the opening-unit-side working space C, the maintenance of the opening unit is enabled through a hand hole 5. In the operating-mechanism-side working space B, the spring operating mechanism 2 can be removed from the breaker.

The main-bus container 11, 12 are provided with removable support posts 13, 14, respectively, the support posts 13, 14 being installed on the common frame 1, and the gas insulated switchgear adopts a configuration enabling necessary works to be performed without removal of the main-bus containers 11, 12, and the disconnectors 18, 19, respectively, even at the time of removing the gas circuit breaker 33 in the case of an accident or an inspection.

A current transformer 17 for use as a measuring instrument is connected to an end of the gas circuit breaker 33, on the right side thereof, in the direction parallel to the plane of the figure, via a flange. The current transformer 17 is provided with a line-side vertical-type disconnector 20 via an insulating spacer 122. The line-side disconnector 20 is provided with an earthing device 26. A current transformer 31 for use as a measuring instrument and an earth cable head 32 are connected to an end of the disconnector 20, on the right side thereof, in the direction parallel to the plane of the figure, via an insulating spacer 28.

In FIG. 6, there is shown a configuration of the gas insulated switchgear, as seen from the arrows A-A of FIG. 5, at an eye point from above. The main-bus containers 11, 12 each collectively house three-phase buses. In each-phase, the current transformer 16 for use as the measuring instrument shown in FIG. 5, is generally provided below the bus-connection conductor 25 connected between the disconnectors 18, 19, shown in FIG. 6.

The disconnector 20 depicted in FIG. 5 is connected to a lower part of the earthing device 26. The earthing device 26 is connected to the current transformer 31 for use as the measuring instrument via the insulating spacer 28. The earth cable head (at 32 in FIG. 5) connected to a transmission line (not shown) is provided below the current transformer 31 for use as the measuring instrument.

The hand hole 5 provided for use in the maintenance of the opening unit is disposed on the upper surface of the sealed tank 4. As the opening-unit-side working space C is provided above the hand hole 5, as show in FIG. 5, the maintenance of the opening unit can be performed with ease by opening up the hand hole 5 after the insulating gas in the sealed tank 4 is recovered.

With the present invention, the flange of a driving-source opening elastic body case is integrated with the flange of a driving-source closing elastic body case, as described in the foregoing, so that vibration due to the operation at the time of the opening operation can be suppressed, thereby enabling enhancement in the efficiency of the energy for driving the movable contact.

Further, by fixing the end of the closing elastic body case to the mechanism unit, the vibration due to the operation at the time of the closing operation, as well, can be suppressed.

Furthermore, by removing the detachable/attachable waterproof cover provided in the space between the flange of the opening elastic body case and the mechanism unit, the length of the link provided between the opening spring and the movable contact can be adjusted, and therefore, on-site maintainability can be enhanced.

With the gas circuit breaker according to the present invention, the sealed tank and the spring operating mechanism are laterally disposed in the axial direction, thereby enabling the total-height of the gas insulated switch gear to be suppressed. By so doing, the gas insulated switchgear in whole can be housed in a shipping container (for example, a 40-feet container according to ISO Specification) without disassembling the gas insulated switchgear, so that a transportation cost can be reduced, and on-site installation time can be cut down.

In addition, with the adoption of the configuration described as above, lowering of the center of gravity with respect to the gas insulated switchgear can be realized, so that earthquake-resistance can be enhanced as a collateral effect.

What is claimed is:

1. A gas circuit breaker having a fixed contact, a movable contact coming into contact with, and being dissociated from the fixed contact, a sealed tank having the fixed contact and the movable contact therein, an operating mechanism for driving the movable contact, and a mechanism unit provided between the sealed tank and the operating mechanism, the operating mechanism comprising:

an elastic body as a driving source;

a case for housing the elastic body;

an actuator for holding and freeing a driving force of the elastic body; and a link mechanism for conveying the driving force of the elastic body to the movable contact, wherein the elastic body is made up of an opening elastic body and a closing elastic body, the opening elastic body is laterally disposed in an axial direction between the link mechanism and the actuator, and a flange provided on an opening elastic body case is integrated with a flange provided on a closing elastic body case, and space is provided between the flange of the opening elastic body case and the mechanism unit.

2. The gas circuit breaker according to claim 1, wherein an operation axis of the opening elastic body is provided so as to be substantially parallel with an operation axis of the movable contact.

3. The gas circuit breaker according to claim 1, wherein a detachable/attachable waterproof cover is provided in the space.

4. The gas circuit breaker according to claim 2, wherein space is provided between the flange of the opening elastic body case and the mechanism unit, and a detachable/attachable waterproof cover is provided in the space.

5. The gas circuit breaker according to claim 3, wherein the waterproof cover is rendered dividable in the vertical direction.

6. The gas circuit breaker according to claim 4, wherein the waterproof cover is rendered dividable in the vertical direction.

7. The gas circuit breaker according to claim 1, wherein an end of the closing elastic body case is joined to an end of the mechanism unit.

8. The gas circuit breaker according to claim 2, wherein an end of the closing elastic body case is joined to an end of the mechanism unit.

9. The gas circuit breaker according to claim 3, wherein an end of the closing elastic body case is joined to an end of the mechanism unit.

10. The gas circuit breaker according to claim 4, wherein an end of the closing elastic body case is joined to an end of the mechanism unit.

11. The gas circuit breaker according to claim 5, wherein an end of the closing elastic body case is joined to an end of the mechanism unit.

12. The gas circuit breaker according to claim 6, wherein an end of the closing elastic body case is joined to an end of the mechanism unit.

* * * * *